United States Patent [19]

La Porte

[11] Patent Number: 4,640,539

[45] Date of Patent: Feb. 3, 1987

[54] DEVICE FOR PICKING UP SMALL PIECES OF LITTER

[76] Inventor: Allen R. La Porte, 240 Jones Rd., Kerrville, Tex. 78028

[21] Appl. No.: 789,320

[22] Filed: Oct. 21, 1985

[51] Int. Cl.[4] ..... A47L 13/00

[52] U.S. Cl. ..... 294/19.1; 294/1.1; 15/104 A

[58] Field of Search ..... 294/19.1, 1.1, 61; 15/104 R, 104 A, 231, 98

[56] References Cited

U.S. PATENT DOCUMENTS 3,742,547 7/1973 Sohmer ..... 15/104 A 4,083,675 4/1978 Hester ..... 294/1.1

*Primary Examiner*—James B. Marbert

*Attorney, Agent, or Firm*—Gunn, Lee & Jackson

[57] ABSTRACT

The present invention has a rod with a handle on one end and on the other end a means for dispensing tape. A means for actuating a take-up reel for the tape is also provided. By operating the actuating means, the take-up reel is advanced, tape from the dispensing means is drawn over a roller mounted on the lower end of the rod. Because the sticky portion of the tape is away from the roller, the tape may be pressed against small pieces of litter located on the ground, which small pieces of litter stick to the tape and are wound around the take-up reel. The actuating means controls how rapidly the tape will be dispensed and taken up.

6 Claims, 10 Drawing Figures

DEVICE FOR PICKING UP SMALL PIECES OF LITTER

BACKGROUND OF THE INVENTION

The present invention relates to a device for picking up small pieces of litter and, more particularly, a rod having a handle on a first end. A second end of the rod has a dispensing reel and a take-up reel for mounting tape thereon. An actuating means causes tape from the dispensing reel to be dispensed over a lowermost roller on the rod and taken up on the take-up reel. The sticky side of the tape, which is away from the roller, may be pressed against small pieces of litter to pick up the small pieces of litter on the tape. The small pieces of litter are subsequently wound around with the tape on the take-up reel.

BRIEF DESCRIPTION OF THE PRIOR ART

Large sums of money are being spent every day to hire individuals to pick up litter. While major litter, such as cans or bottles or large pieces of paper, are normally picked up at least on a periodic basis in public facilities, smaller amounts of litter such as cigarette butts, beverage caps, pull tabs (just to name a few) are normally not picked up. This is especially true around public parks or public recreation areas.

A reason why the smaller pieces of litter such as cigarette butts or pull tabs are never picked up is because it requires someone picking up the litter to bend over and physically pick up the small pieces of litter with their fingers. If the small pieces of litter are very close together, it may even result in the individual picking up litter having to crawl on hands and knees to pick up the small pieces of litter.

Presently in public areas, there are individuals who are assigned with bags and a stick with a sharp point on one end thereon to pick up litter. These individuals will go around the parks or recreation areas and pick up the larger items of litter. However, pull tabs, cigarette butts, or beverage tops normally will not stick to the sharp point of the stick and hence are not picked up. Normally the individually picking up the litter will not physically bend over and pick up the smaller pieces of litter, such as pull tabs, bottle caps, or cigarette butts.

While there are many different types of tape dispensing machines that have been used for many purposes, applicant is not aware of the use of a rod approximately the same length as a walking cane which has a handle on the upper end and a tape dispensing means on the lower end. In the present invention, there must also be some type of actuating means to dispense the tape from a dispensing roller and to take up the tape and small pieces of litter stuck thereto on a take-up roller. The sticky side of the tape must extend over a roller at the lower end of the rod. The sticky side of the tape may then be pressed against small pieces of litter and rolled up in the take-up reel. Applicant is not aware of any type of similar device that is available in the market today.

SUMMARY OF THE INVENTION

It is an object of the present invention to provide a device for picking up small pieces of litter.

It is another object of the present invention to provide a device for picking up small pieces of litter without the necessity of the individual using the device to have to bend or stoop.

It is yet another object of the present invention to provide a rod about the same length as a typical walking cane having on an upper end a handle and on a lower end a means for dispensing tape with the sticky side down across a lowermost roller so that the sticky portion of the tape can pick up the small pieces of litter.

It is a further object of the present invention to provide a means for advancing tape for picking up small pieces of litter across a lowermost portion of a rod, which tape may be pressed against small pieces of litter to cause them to adhere thereto and be wound up on the take-up reel for the tape.

It is yet another object of the present invention to provide a lightweight device for picking up small pieces of litter that can be used without the necessity of bending or stooping. The device would include a handle on the upper end of a rod, the length of the rod being about the same as a typical walking stick. The lower end of the rod would have a means for actuating a take-up reel for tape. By connecting tape from a dispensing reel, across a lower most pick-up roller, and to the take-up reel, an actuating means that turns the take-up reel could control the movement of the tape as desired. All that is necessary is that the actuating means turn the take-up reel when additional tape is needed to adhere to additional small pieces of litter.

It should be realized that many different types of actuating means could be used to turn the take-up reel, including an advancing rod that would be pushed upward each time the entire device is pressed downward to pick up a small piece of litter. The advancing rod could advance the take-up reel a small amount and hence advance the tape a small amount each time the advancing rod is pressed upward.

Many other types of advancing mechanisms could be used, including a ratchet, band wrench, motor drive, pull lever, just to name a few. It may even be possible to use the sticky surface of the tape and roll the tape on the surface containing the litter to control the advance. It should be realized that many different types of advancing means for the take-up reel could be used without departing from the spirit and scope of the present invention.

By proper design, a major portion of the device could be made by injection molding, including mounting surfaces for the dispensing reel and the take-up reel for the tape. The actuating means can be mounted on the same support structure as the actuating means for advancing the take-up reel.

In a preferred embodiment, an advancing rod is maintained in brackets and extends downward below the lowermost portion of the tape in a direction generally parallel to the rod. As the advancing rod is pressed against the surface containing the small piece of litter, the advancing rod is pushed upward thereby moving upward a lever that connects to the take-up reel. The upward movement of the lever causes the take-up reel to advance. Thereafter the advancing rod is returned to its original position with the entire device when the device is picked up due to the spring loading on the advancing rod. However, when the advancing rod returns to its original position, the take-up reel does not turn.

Because the small pieces of litter being picked up on the tape and wound around the take-up reel are irregular in shape and may extend over the edges of the tape, the take-up reel only has support on one side thereof and is open on the other side. So that the used tape can be removed from the take-up reel, the take-up reel may have a portion of the tape reversed wound at the centermost portion thereof to prevent the sticky surface from sticking to the take-up reel. It also may be possible to have a throwaway sleeve extending over the take-up reel. The dispensing reel should also have a quick mount mechanism so a person can quickly mount a new roll of tape thereon for the picking up of additional small pieces of litter.

DESCRIPTION OF THE PREFERRED EMBODIMENT

Figures 1, 2:
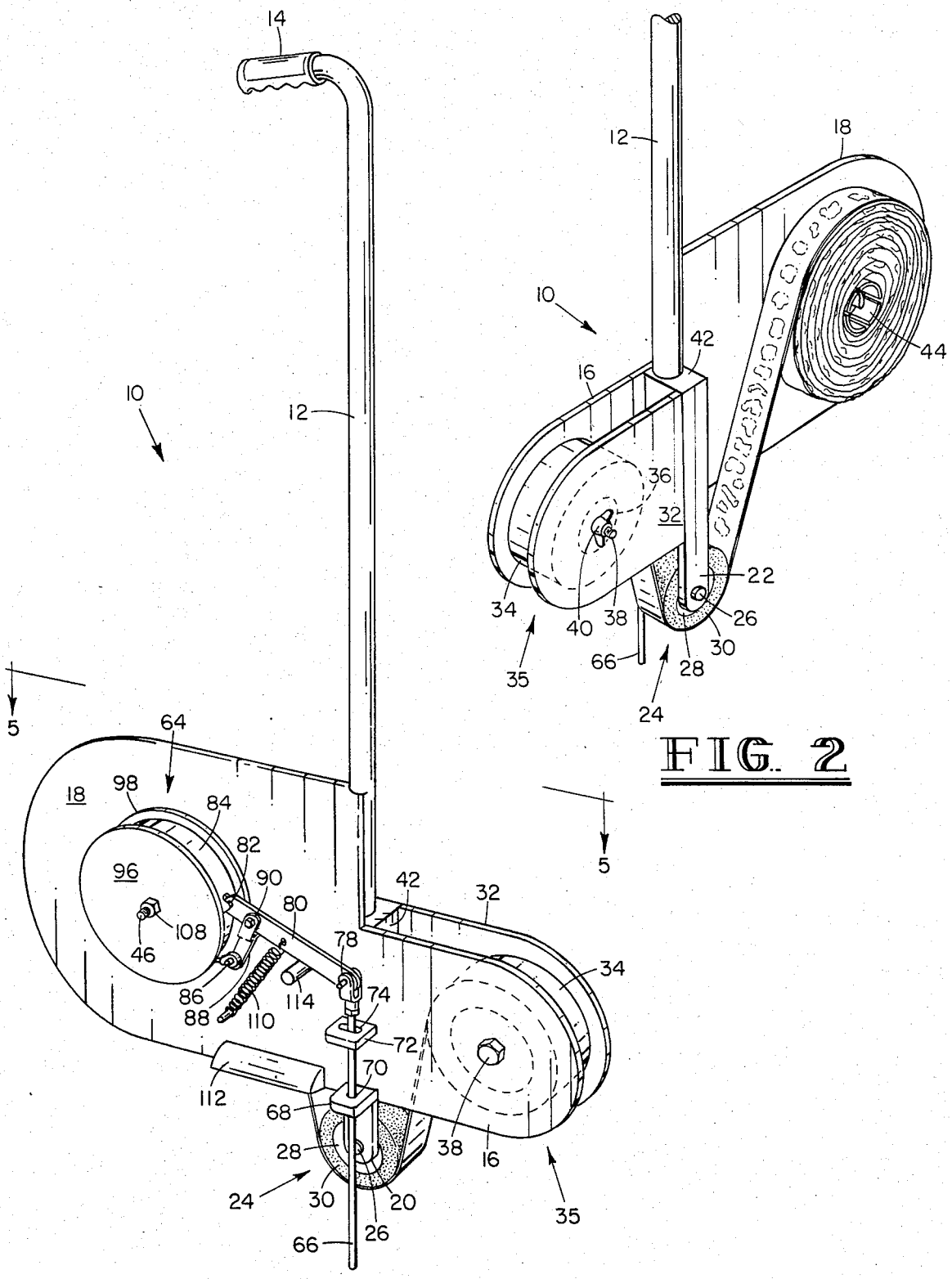
FIG. 1 is a perspective view of a device for picking up small litter.
FIG. 2 is a partial opposing perspective view from FIG. 1 with an upper portion of a rod and a handle being cut off.

Referring now to FIG. 1 of the drawings, a device for picking up small pieces of litter is represented generally by reference numeral 10. The device includes a rod 12, which rod 12 is about the same length as a typical walking cane. The upper end of rod 12 has a handle formed thereon for ease of use of the device 10. The lower end of the rod 12 has connected thereto a dispensing plate 16 and a take-up plate 18. While the dispensing plate 16 and the take-up plate 18 may be attached to the rod 12 by any convenient means, it is presently envisioned that the handle 14, rod 12, dispensing plate 16, and take-up plate 18 will all be formed integrally by one molded structure. Extending below the dispensing plate 16 and take-up plate 18 are pick-up flanges 20 and 22 on which can be pivotally mounted a pick-up roller 24.

The pick-up roller 24 is mounted on the pick-up flanges 20 and 22 by means of an axle 26, which axle 26 may be formed of any convenient means such as a bolt and nut combination. The inner portion of the pick-up roller 24 is formed of a rigid cylinder 28; however, the outer portion of the pick-up roller 24 is formed from a soft resilient material 30, such as foam or a rubber type product. This is to allow the resilient material 30 of the pick-up roller 24 to be pressed in when picking up small pieces of litter as will be described subsequently.

Referring to FIGS. 1 and 2 in combination, a dispensing back plate 32 is located on the opposite side of rod 12 from the dispensing plate 16. Located between the dispensing plate 16 and the dispensing back plate 32 is a roll of tape 34. The tape 34 is free to rotate about hub 36, which is held in position by bolt 38 secured on one end by wing nut 40. The hub 36 will have sufficient thickness to prevent the roll of tape 34 from binding between dispensing plate 16 and dispensing back plate 32.

While it should be realized that the roll of tape 34 may vary in width, applicant presently envisions that the roll of tape 34 would typically be a two inch wide masking tape; however, the width of the tape and type of tape may vary. To accomodate a two inch wide masking tape, spacer 42 is provided between dispensing back plate 32 and rod 12. The spacer 42 may be formed integrally with rod 12 or may be separately attached thereto for accomodating different widths of tape. The roll of tape 34 may be quickly replaced by removing wing nut 40, removing dispensing back plate 32, and another roll of tape inserted over the hub 36. Thereafter by replacing the dispensing back plate 32 and wing nut 40, a new roll of tape has been inserted.

Figure 7:
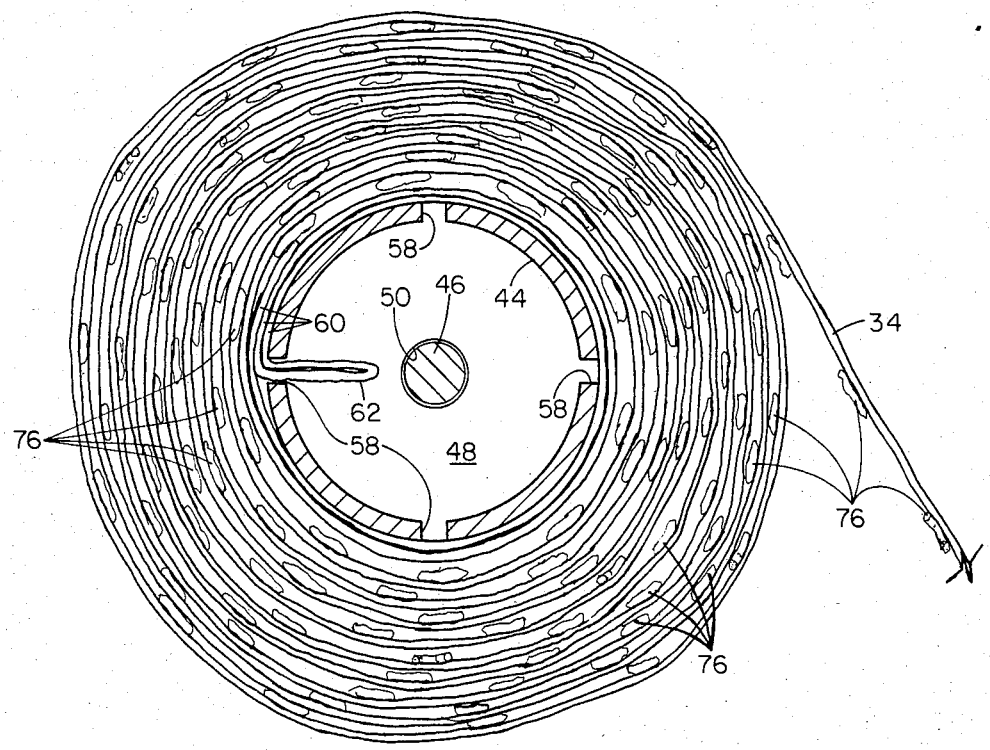
FIG. 7 is a sectional view of FIG. 5 along section lines 7—7.
Figure 8:
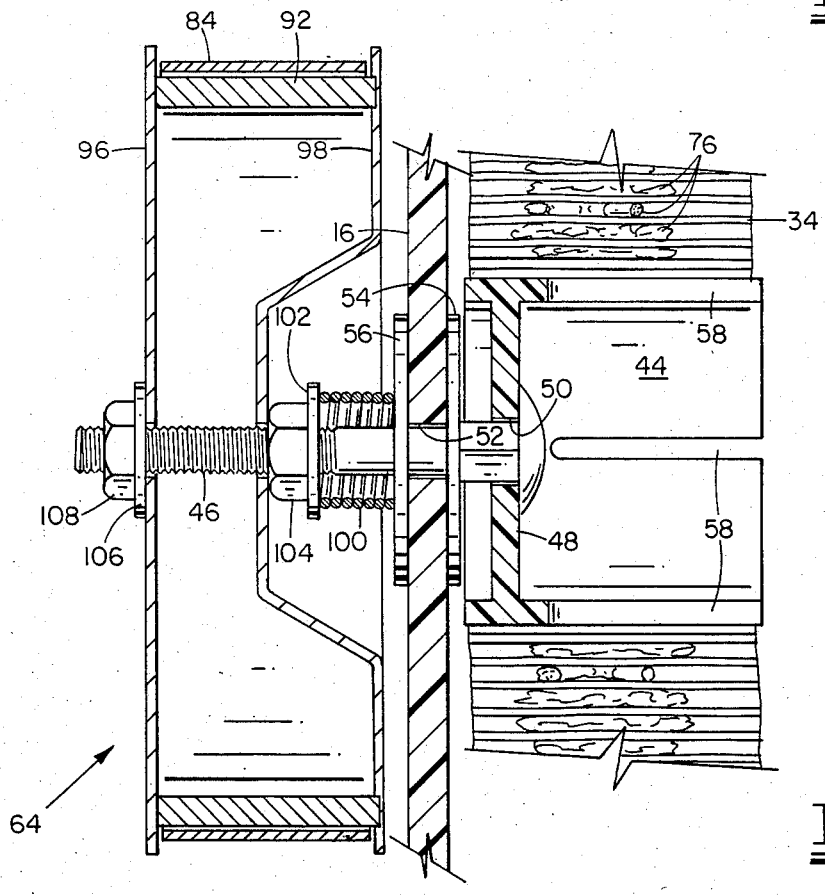
FIG. 8 is a sectional view of FIG. 5 along section lines 8—8.

Referring now to FIG. 2 in combination with FIG. 7, a take-up reel 44 is mounted on take-up plate 18. The take-up reel 44 is mounted on take-up plate 18 by means of bolt 46. Referring to FIG. 8, it can be seen that the take-up reel 44 is basically formed as a cylinder that is open at one end, but has an end plate 48 at the other end thereof. The bolt 46 extends through opening 50 in the end plate 48 of the take-up reel 44. The bolt 46 also extends through opening 52 in dispensing plate 16. To prevent drag, washers 54 and 56 are located on the bolt 46 on either side of dispensing plate 16.

Slots 58 are cut in the take-up reel 44 down to the end plate 48. While any number of slots 58 may be cut, in the present invention applicant utilizes four slots located an equal distance apart cut in the take-up reel 44 as shown. To extend the tape 34 from the dispensing reel represented generally by reference numeral 35, the tape is drawn over pick-up roller 24, a portion of the tape reverse lapped on itself as represented by referrence numeral 60 in FIG. 7, and the tip 62 extended through one of the slots 58. The reverse lapping of the tape 60 puts both of the sticky surfaces of the tape together and prevents tape 34 that is being taken up on take-up reel 44 from sticking thereto. The enlarged view of FIG. 7 illustrates the reverse lapping of the tape. By inserting the tip 62 through one of the slots 58, the take-up reel 44 can be used to pull the tape 34 off of the dispensing reel 35.

Figure 3:
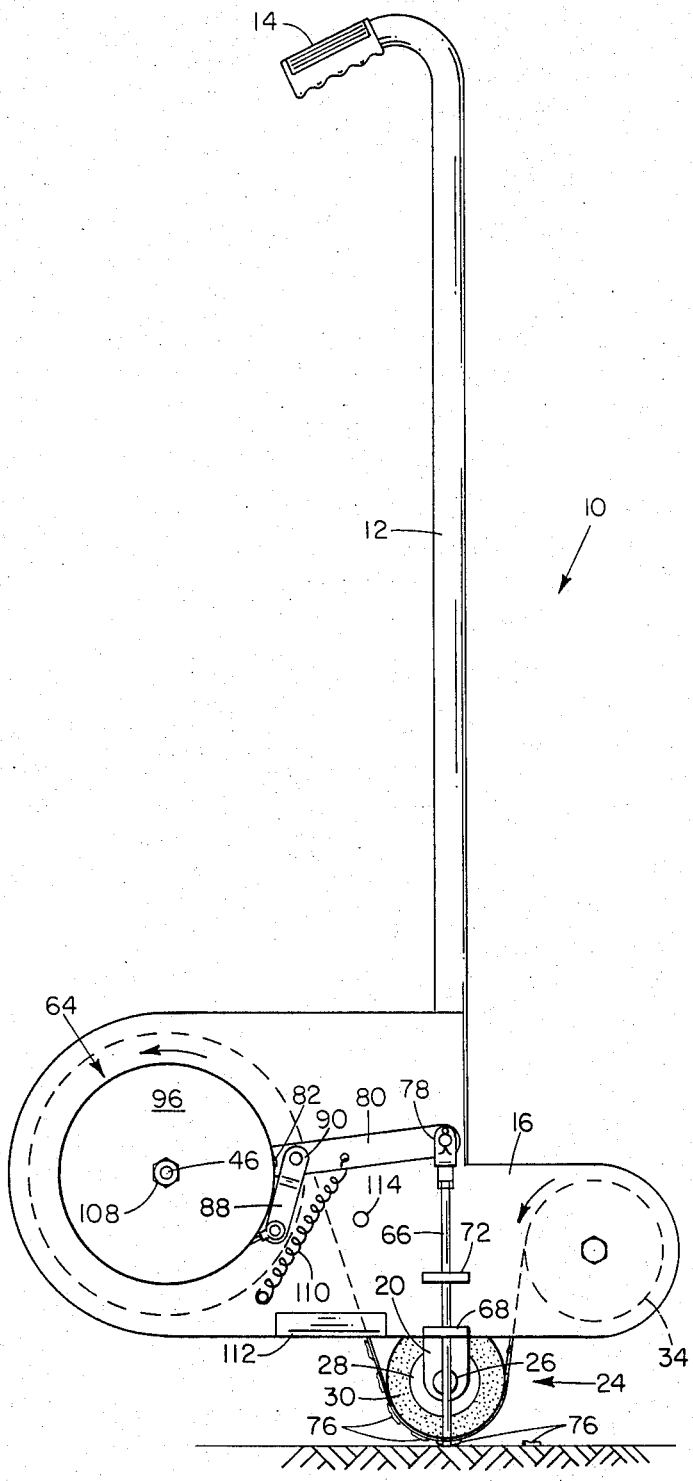
FIG. 3 is an elevated front view showing the device for picking up small litter in use.
Figure 6:
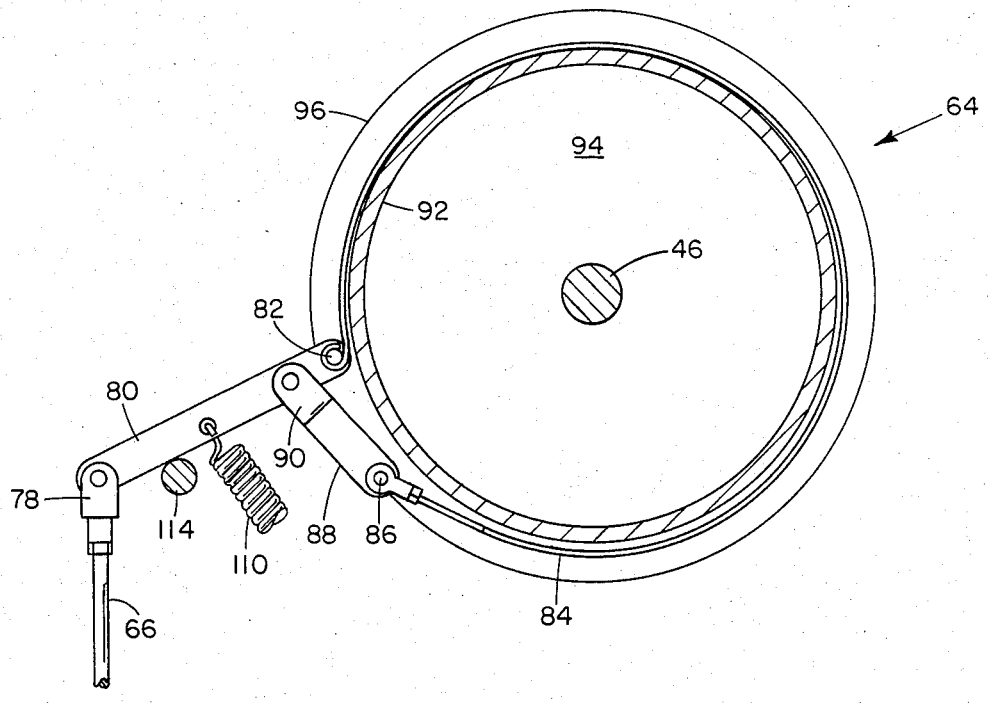
FIG. 6 is a cross-sectional view of FIG. 5 along section lines 6—6.

Referring now to FIG. 1 in combination with FIGS. 6 and 8, the advancing mechanism represented generally by reference numeral 64 will be explained. An advancing rod 66 extends below pick-up roller 24 in a direction generally parallel with rod 12. The advancing rod 66 is maintained in position by support bracket 68, which has a hole 70 therein to allow the advancing rod 66 to freely slide therethrough. Located above support bracket 68 is upper support bracket 72 which has a slot 74 located therein to allow the advancing rod 66 to move therethrough. Because of the arcuate motion of the advancing rod 66, it is necessary that one opening be in a slot configuration, such as slot 74. By placing the lowermost point of the advancing rod 66 adjacent to the litter to be picked up (as illustrated in FIG. 3) and pushing downward on the device 10, the advancing rod 66 is pushed upward and the tape 34 comes in contact with the litter represented by reference numeral 76.

The upper end of the advancing rod 66 is connected by a yoke connection 78 to lever arm 80. One end of the lever arm 80 is connected by pin 82 to flexible band 84.

The opposite end of flexible band 84 is connected by pin 86 to offset arm 88. The opposite end of offset arm 88 is connected by yoke connection 90 to lever arm 80 at a location between yoke 78 and pin 82. Inside of flexible band 84 is a drive pulley 92 that pressed outer flange 96 and inner flange 98 and connected to bolt 48.

Upward motion of the advancing rod 66 forces up the lever arm 80 through yoke connection 78. Movement of the lever arm 80 tightens the flexible band 84 against the drive pulley 92 via the offset arm 80. Continued upward motion of lever arm 80 will then cause rotation of the flexible band 84 as well as the drive pulley 92 and flanges 96 and 98. Since the flanges 96 and 98 are connected to bolt 46 with compression being maintained by coil spring 100, the bolt 46 will also turn. The rotational motion of bolt 46 is transmitted through to the take-up reel 44 thereby causing take-up reel 44 to also rotate. To insure that flexible band 84 will remain on the drive pulley 92, outer flanges 96 and inner flange 98 extend outward beyond drive pulley 92.

While any convenient means can be used to attach flanges 96 and 98 and drive pulley 92 to bolt 46, a method used by applicant is having a coil spring 100 surrounding bolt 46 followed by a washer 102 and nut 104. This provides for continuous pressure on the inner flange 98. The drive pulley 92 and hub 94 may be attached to the bolt 46 by a washer 106 and nut 108. The coil spring 100 also holds the take-up reel 44 securely on bolt 46 for rotation therewith.

After the advancing rod 66 has been pushed upward as illustrated in FIG. 3, once the entire device 10 is picked up with the litter 76 being stuck to tape 34, a spring 110 pulls down on lever arm 80. Downward motion of lever arm 80 loosens the flexible hand 84 via offset arm 88 to allow the flexible band 84 to spin on the drive pulley 92. Therefore as the spring 110 pulls the lever arm 80 down and returns advancing rod 66 to its original position, the drive pulley 92 will not turn. This type of advancing mechanism 64 moves fresh tape 34 immediately below pick-up roller 24 for picking up additional litter.

The pieces of litter 76 are very irregular in shape and have a tendency to extend beyond the edge of the tape. Therefore as the tape 34 is collected as can be seen in FIGS. 2 or 7, the tape 34 and litter forms a large bulky mass even with portions of litter extending over the edge. To insure that the litter does not hang on the take-up plate 18, a tapered surface 112 is provided in the lower center edge of take-up plate 18 to force the litter 76 and tape 34 onto the take-up reel 44. Also a stop 114 prevents the spring 110 from pulling the lever arm 80 and advancing rod 66 below its desired position. The lever arm 80 simply abuts against the stop 114 once the lowermost position of the advancing rod is reached.

Figure 4:
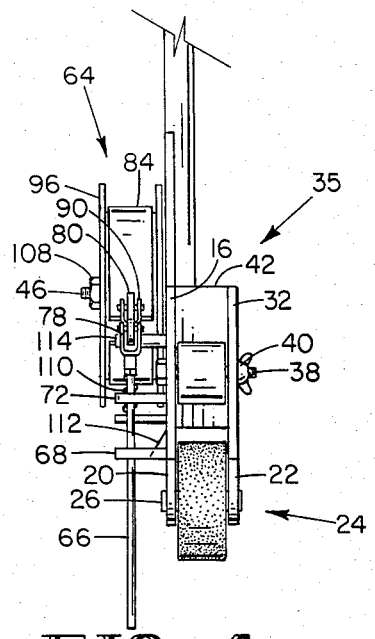
FIG. 4 is a right side elevation view of the lower portion of FIG. 1 without tape thereon.
Figure 5:
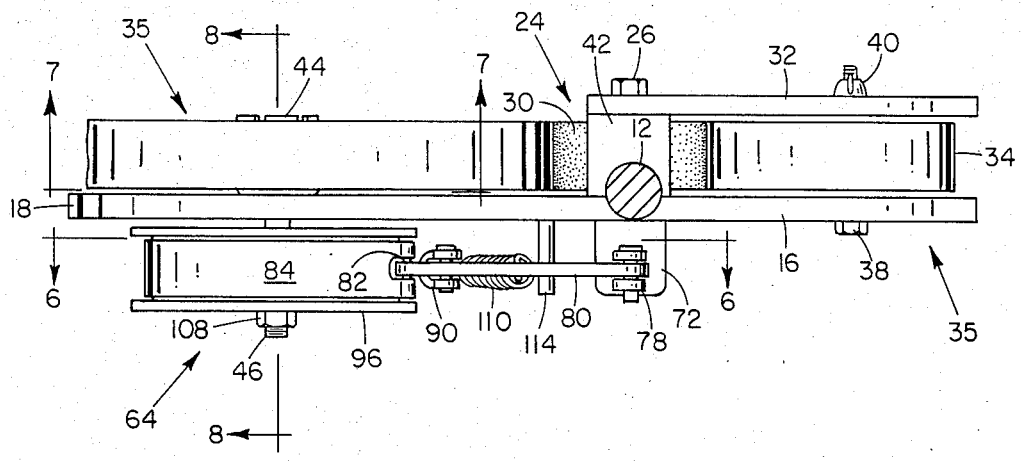
FIG. 5 is a sectional view of FIG. 1 along section lines 5—5.

For a better understanding of the overall operation of the device 10, a side view of FIG. 1 without the tape is illustrated in FIG. 4. FIG. 3 illustrates the device in use with tape 34 being pressed against litter 76. FIG. 7 illustrates a method of connecting the tape to the take-up reel 44. However, it should be realized that a throw-away spool or cylinder could be located on take-up reel 44 and work equally as well. All that would be necessary is that the tape to be removed be slid off the open end of the take-up reel 44.

It should be realized that many different types of tape could be used other than two inch masking tape as currently used by applicant. All that is necessary is that the tape be economical so it can be disposed of after use, be sticky enough to hold the pieces of litter, but not be so sticky as to be difficult to unwind.

Figure 9:
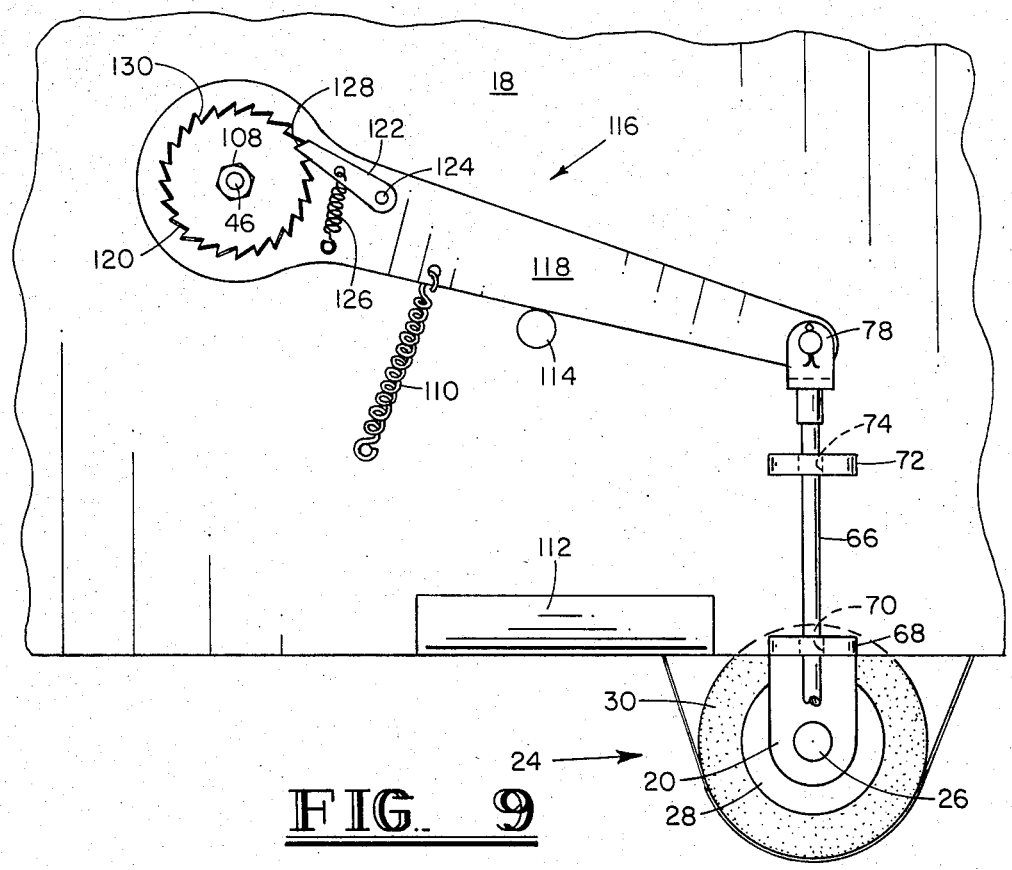
FIG. 9 is a partial elevation view of the device for picking up small pieces of litter illustrating a first alternative for advancing a take-up reel.

It also should be realized that numerous different types of advancing mechanisms can be used with a first alternative advancing mechanism being represented generally by reference numeral 116 in FIG. 9. Like numbers will be used to designate like components as in FIGS. 1 through 8. In the first alternative advancing mechanism 116, the lever arm 80 and the drive pulley 92 have been removed. Located in place thereof is ratchet arm 118 that is connected by yoke connection 78 to advancing rod 66. The ratchet arm 118 is free to rotate on bolt 46. However rigidly attached to bolt 46 is ratchet 120, which is immediately adjacent to ratchet arm 118. As ratchet arm 118 moves upward, ratchet pin 122 is pivotally mounted on pivot pin 124 and pulled against ratchet 120 by spring 126 so that the tip 128 of ratchet pin 122 fits in the indentations formed by the ratchet 120. Therefore upward motion of the ratchet arm 118 causes the ratchet 120 to pivot therewith via ratchet pin 122. However, as the ratchet arm 118 moves downward with the advancing rod 66, the ratchet pin 122 will not fit in the indentations 130 to cause a rotation of the ratchet 120. Rotation of the ratchet 120, because of its rigid connection with bolt 46, will cause rotation of the take-up reel 44 in the same manner as previously described.

Figure 10:
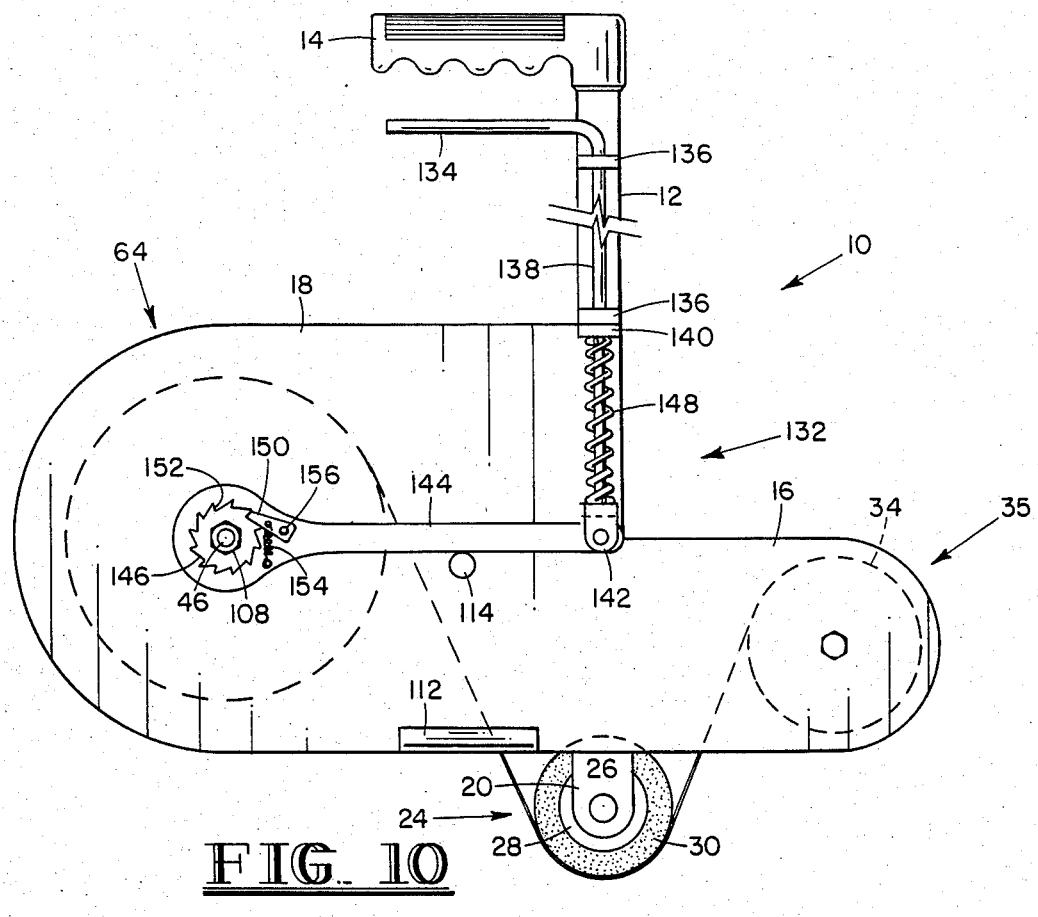
FIG. 10 is a partial elevation view of the device for picking up small pieces of litter illustrating a second means for advancing a take-up reel.

Referring now to FIG. 10, a second alternative advancing mechanism is shown and represented generally by reference numeral 132. The second alternative advancing mechanism 132 has a lever 134 located immediately below handle 14, which lever 134 is slidably retained on rod 12 by mounting brackets 136. Lever 134 has a pull rod 138 that slides inside of mounting brackets 136. The pull rod 138 also extends through bracket 140 with the lowermost portion of the pull rod 138 having a yoke connection 142 with ratchet arm 144. Again ratchet arm 144 is free to rotate on one end around bolt 46. However, ratchet 146 is rigidly connected to bolt 46. As the lever 134 is pulled upward by the user of the device 10, pull rod 138 will pull up ratchet 146 thereby compressing spring 148. Upward motion of ratchet arm 144 causes ratchet 146 to rotate due to ratchet pin 150 pressing against the indentations 152 of ratchet 146. However, as lever 134 is released and spring 148 moves lever 134 and pull rod 138 downward, ratchet arm 144 will also move downward. However, ratchet pin 150 will not be forced into the indentations 154 and will not rotate ratchet 146. The rotation of ratchet 146 via bolt 36 causes rotation of the take-up reel 44 as previously described. Spring 154 continually pulls downward on ratchet pin 150, which is pivotally connected by pin 156 so that the ratchet pin 150 is continually being pressed against ratchet 146.

While applicant has illustrated three separate methods of advancing the take-up reel 44, it should be realized that other methods of advancing the take-up reel could also be used. For example, some type of motor could be used in turning the take-up reel. However, it may be costly and bulky to have a separate motor that would drive the take-up reel to provide the actuating means.

Another type of actuating means could be a separate wheel that could be rolled on the ground to advance the tape. Also the tape itself could be rolled on the ground to provide the source of drive for the take-up reel. However, if the tape being rolled on the ground is providing the source of drive, some type of pulley with a belt connection is necessary between the roller for the tape and the take-up reel. It is even possible to use a spring loading on the take-up reel, such as would be provided in wind-up toys. The simply pulling of a lever could release the spring a predetermined distance to thereby advance the tape a predetermined distance. As another alternative, the pick-up roller could itself be the take-up reel so that as the tape rolls along the ground and picks up litter, it is simultaneously being wound on the pick-up roller. Thereafter by removing an outer plate, the pick-up roller can be replaced or the tape removed therefrom. Again this would necessitate a type of ratchet drive for the pick-up roller. It is obvious from the various described means of actuating the take-up roller that many different types of advancing mechanisms can be used and still not depart from the spirit of the scope of the present invention.

I claim:

1. A device for picking up small pieces of litter, using a roll of tape that is sticky on one side, comprising:

a rod of a rigid material having a length generally equal in length to a walking cane;

a handle located on an upper end of said rod;

a means for mounting a pick-up roller, said pick-up roller mounting means being located on the lower end of said rod, said pick-up roller mounting means including roller flanges extending downward from said rod, and a pick-up roller axle between said roller flanges;

a roller mounted on said roller axle, said roller having a rigid inner cylinder and a resilient outer cylinder bonded thereto for pressing said sticky side of said tape against said small pieces of litter;

a means for dispensing tape, said dispensing means including a dispensing reel located above and in front of said roller, with the axis of rotation of said dispensing reel being parallel to the axis of rotation of said roller, said dispensing reel comprising a hub between a dispensing plate and dispensing back plate, said dispensing plate being attached to said rod near said lower end thereof and mounted on a first side of and above said pick-up roller, said dispensing back plate being located on the opposite side of said rod from said dispensing plate;

a means for taking-up tape, said take-up means including a take-up plate attached to said rod near the lower end thereof and mounted on a second side of and above said roller means, and a take-up reel rotatably mounted cylinder mounted on said take-up plate, said take-up reel being a cylinder, an external end of said cylinder being open and having slot therein parallel to the axis of rotation of said take-up reel, said slots being of sufficient size to receive a starting end of said tape;

a means for advancing said tape including an actuating rod extending below said pick-up roller means and a means for rotating said take-up reel, said actuating rod being movable in a generally vertical direction, said actuating rod being pivotally connected to said take-up means to cause rotation with a first direction of motion of said actuating rod but not in a second direction of motion of said actuating rod, spring means for returning said actuating rod to a lowermost position.

2. The device for picking up small pieces of litter as recited in claim 1 wherein said tape dispensing means includes a spacer between said dispensing back plate and said rod.

3. The device for picking up small pieces of litter as recited in claim 2 wherein said tape take-up means includes a tapered surface in the lower center edge of said take-up plate to force said litter and said tape onto said take-up reel.

4. The device for picking up small pieces of litter as recited in claim 1 wherein said handle, rod and dispensing plate and take-up plate are formed in one integral piece.

5. The device for picking up small pieces of litter as recited in claim 1 wherein said means for rotating said take-up reel includes a yoke connector, a lever arm, a tension band for gripping a pulley to cause said rotation, and an offset arm.

6. A device for picking up small pieces of litter, using a roll of tape that is sticky on one side, comprising:

a rod of a rigid material having a length generally equal in length to a walking cane;

a handle located on an upper end of said rod;

a means for mounting a pick-up roller, said pick-up roller mounting means being located on the lower end of said rod, said pick-up roller mounting means including roller flanges extending downward from said rod, and a pick-up roller axle between said roller flanges;

a roller mounted on said roller axle, said roller having a rigid inner cylinder and a resilient outer cylinder bonded thereto for pressing said sticky side of said tape against said small pieces of litter;

a means for dispensing tape, said dispensing means including a dispensing reel located above and in front of said roller, with the axis of rotation of said reel being parallel to the axis of rotation of said roller, said dispensing reel comprising a hub between a dispensing plate and dispensing back plate, said dispensing plate being attached to said rod near said lower end thereof and mounted on a first side of and above said pick-up roller, said dispensing back plate being located on the opposite side of said rod from said dispensing plate;

a means for taking-up tape, said take-up means including a take-up plate attached to said rod near the lower end thereof and mounted on a second side of and above said roller means, and a take-up reel being a cylinder, an external end of said cylinder being open and having slots therein parallel to the axis of rotation of said take-up reel, said slots being of sufficient size to receive a starting end of said tape, and said take-up means including a tapered surface in the lower center edge of said take-up plate to force said litter and said tape onto said take-up reel.

a means for advancing said tape, said tape advancing means including lever means extending downward from said handle, ratchet means on a lower end of said lever means to advance said advancing means in one direction upon moving said lever means in a generally vertical direction with respect to said rod, spring means for returning said lever means to a rest position.

* * * * *